US009371646B2

(12) United States Patent
Magoon et al.

(10) Patent No.: US 9,371,646 B2
(45) Date of Patent: Jun. 21, 2016

(54) THERMAL BREAK FOR CURTAIN WALL

(71) Applicant: Pella Corporation, Pella, IA (US)

(72) Inventors: Robert D. Magoon, Monett, MO (US); James Alan Hughes, Monett, MO (US); Chris Smith, Murray, KY (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 14/365,559

(22) PCT Filed: Dec. 12, 2012

(86) PCT No.: PCT/US2012/069223

§ 371 (c)(1),
(2) Date: Jun. 13, 2014

(87) PCT Pub. No.: WO2013/090415

PCT Pub. Date: Jun. 20, 2013

(65) Prior Publication Data

US 2014/0345215 A1 Nov. 27, 2014

Related U.S. Application Data

(60) Provisional application No. 61/570,638, filed on Dec. 14, 2011.

(51) Int. Cl.

| | |
|---|---|
| ***E04B 2/96*** | (2006.01) |
| ***E06B 3/54*** | (2006.01) |
| ***E04B 2/90*** | (2006.01) |

(52) U.S. Cl.

CPC . *E04B 2/965* (2013.01); *E04B 2/90* (2013.01); *E06B 3/5427* (2013.01); *E04B 2/967* (2013.01); *Y10T 29/49801* (2015.01); *Y10T 29/49826* (2015.01); *Y10T 29/49885* (2015.01)

(58) Field of Classification Search

CPC ..... E04B 2/96; E04B 2/90; E04B 2/965; E04B 2/967; E04B 2/88; E06B 3/5427; Y10T 29/49885; Y10T 29/49801; Y10T 29/49826

USPC ..... 52/235

See application file for complete search history.

(56) References Cited

U.S. PATENT DOCUMENTS 3,081,849 A * 3/1963 Eugene ..... E04B 2/96 49/413
3,155,205 A * 11/1964 Piace ..... E06B 3/5821 52/204.591

(Continued)

FOREIGN PATENT DOCUMENTS

| | | | |
|---|---|---|---|
| EP | 1302602 | A1 | 4/2003 |
| EP | 2246496 | A1 | 11/2010 |
| NL | 9100188 | A | 9/1992 |

OTHER PUBLICATIONS

International Search Report and Written Opinion issued in PCT/US2012/069223, mailed Apr. 5, 2013, 15 pages.

*Primary Examiner* — James Ference
(74) *Attorney, Agent, or Firm* — Faegre Baker Daniels LLP

(57) ABSTRACT

A curtain wall panel includes frame with a first frame member defining a channel, a cover configured to extend over the first frame member, a spacer formed of a thermally insulating material, the spacer including a first end, a body, and a second end, the first end being configured to be secured in the channel of the first frame member in a cammed interference fit by rotating a body of the spacer, and the second end being configured to form a cammed interference fit with the cover. An insert is supported from the first frame member by the spacer with the cover fit onto the spacer to capture and secure the insert relative to the frame.

6 Claims, 9 Drawing Sheets

(56) References Cited

U.S. PATENT DOCUMENTS 4,008,552 A * 2/1977 Biebuyck ..... E06B 7/14 52/204.591
4,938,823 A * 7/1990 Balazek ..... B29C 47/003 156/166
5,136,812 A * 8/1992 Voegele ..... E05F 15/619 49/397
5,253,459 A * 10/1993 Parinas ..... E04B 2/96 52/204.591
5,452,552 A * 9/1995 Ting ..... 52/235
5,893,244 A * 4/1999 Magoon ..... 52/235
6,226,940 B1 * 5/2001 Biebuyck ..... E04B 2/962 52/235
6,745,527 B1 * 6/2004 Sherman et al. ..... 52/235
6,748,709 B1 * 6/2004 Sherman et al. ..... 52/235
7,134,247 B2 * 11/2006 Ting ..... 52/235
7,276,132 B2 10/2007 Davies et al.
8,365,481 B2 * 2/2013 Scully et al. ..... 52/235
2002/0121720 A1 * 9/2002 Davies et al. ..... 264/103
2002/0124499 A1 * 9/2002 Braybrook ..... 52/235
2003/0221381 A1 * 12/2003 Ting ..... 52/204.1
2005/0284046 A1 * 12/2005 Neal ..... E06B 1/36 52/204.5
2011/0258945 A1 * 10/2011 Arbour ..... 52/173.3

* cited by examiner

THERMAL BREAK FOR CURTAIN WALL

CROSS-REFERENCE TO RELATED APPLICATION

This application is a national phase application of PCT application No. PCT/US12/69223, internationally filed Dec. 12, 2012, which claims priority to U.S. application 61/570,638, filed Dec. 14, 2011, both of which are herein incorporated by reference in their entirety.

BACKGROUND

A curtain wall is a thin, usually aluminum-framed wall, containing in-fills of glass, metal panels, or thin stone. The framing is attached to a building structure and generally does not carry floor or roof loads of the building structure. Wind and gravity loads of the curtain wall are transferred to the building structure, typically at the floor line.

SUMMARY

The invention pertains to a curtain wall panel that includes a thermally insulating structural spacer. In some embodiments, a curtain wall panel includes a frame that is configured to be secured to an exterior surface of a building structure. The frame includes a first mullion, a second mullion, a sill and a head. A first insert is secured to the frame. A first structural space secures the first insert to the frame and supports the weight of the first insert. The structural space is formed of a thermally insulating material.

The figures are meant to be illustrative in nature and are not to be read as limiting the scope of invention. Additional or alternate features to those shown are contemplated, as understood with reference to the disclosure as a whole.

DETAILED DESCRIPTION

Various embodiments relate to curtain wall systems including a plurality of panels or units assembled together. Such systems are optionally described as "unitized" systems, although a variety of other types of systems are contemplated. Curtain wall systems include individual curtain wall panels, accessories for securing the panels relative to one another, accessories for securing the panels to a building structure (such as the columns and floors of a building structure), as well as other components as desired.

Figure 2:
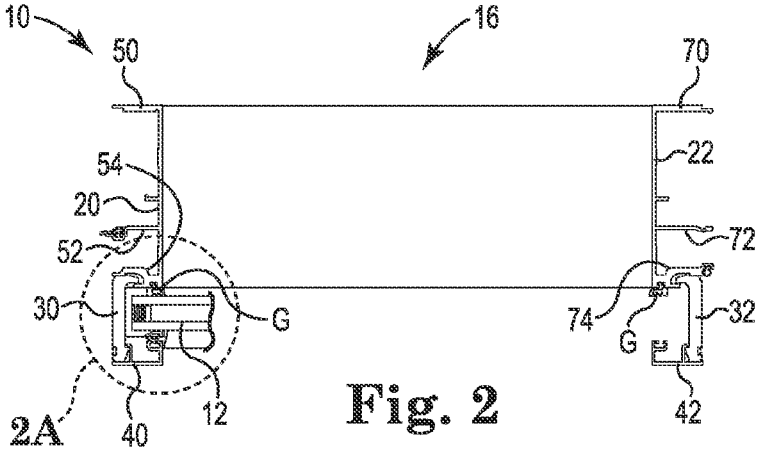
FIG. 2 is a sectional view of the first panel along line 2-2 of FIG. 1, according to some embodiments.
Figure 3:
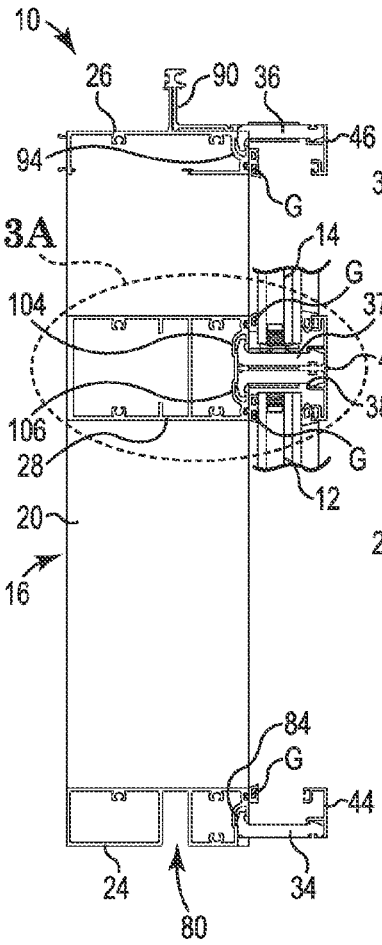
FIG. 3 is a sectional view of the first panel along line 3-3 of FIG. 1, according to some embodiments.
Figure 1:
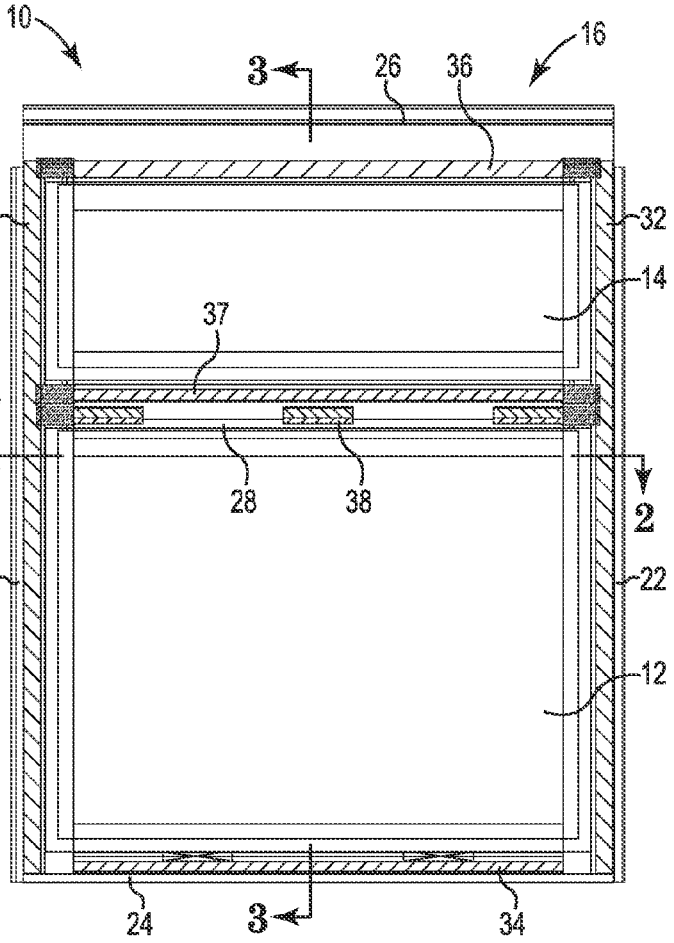
FIG. 1 is a front view of a first panel of a curtain wall system, according to some embodiments.

FIG. 1 is a front view of a first panel 10 of a curtain wall system, according to some embodiments. FIG. 2 is a sectional view of the first panel 10 along line 2-2 in FIG. 1 and FIG. 3 is a sectional view of the first panel 10 along line 3-3 in FIG. 1, according to some embodiments. As shown, the first panel 10 includes a first insert 12, a second insert 14, and a frame assembly 16 supporting the first and second inserts 12, 14. In some embodiments, the first and second inserts 12, 14 are secured into the frame assembly 16 (e.g., in a factory or remote site from a building site) and then the entire first panel 10, along with a plurality of substantially similar panels are shipped to an installation site and secured to a building structure to form the curtain wall system.

As shown, the first and second inserts 12, 14 are insulated glass units, or IG units including one or more opposed glazing sheets separated by spacer and sealant systems with an insulating gas or a vacuum between the glazing sheets (FIGS. 2 and 3 only show an end portion of each of the first and second inserts 12, 14). The inserts 12, 14 are optionally of different sizes, as shown, though similarly sized inserts are contemplated. Additionally, although the inserts 12, 14 are optionally IG units, a variety of other inserts are contemplated, including stone veneer, metal or plastic panels, louvers, and vent inserts, for example.

As shown, the frame assembly 16 includes first and second mullions 20, 22, a sill 24, a head 26, an intermediate member 28, first and second mullion spacers 30, 32, a sill spacer 34, a head spacer 36, an upper intermediate spacer 37, and lower intermediate spacers 38. As shown in one of FIGS. 2 and 3, the frame assembly 16 also includes a first mullion cover 40, a second mullion cover 42, a sill cover 44, a head cover 46, and an intermediate cover 48 (the covers are not shown in FIG. 1). The mullions 20, 22, sill 24, head 26, intermediate member 28, and covers 40, 42, 44, 46 are optionally formed of extruded aluminum material or other material as desired. In some embodiments, one or more of the spacers act as structural components that help support the inserts 12, 14. As described in greater detail, one or more of the spacers 30, 32, 34, 36, 37, 38 are formed of a thermal insulating material (e.g., as opposed to metals such as aluminum or steel, which are generally considered thermally conductive) in the field of fenestration products.

As shown in FIG. 2, the first mullion 20 includes a first interlocking tang 50, a second interlocking tang 52, and a spacer lock 54. As described in greater detail, the first and second interlocking tangs 50, 52 are configured to form a complementary fit with a laterally adjacent panel (FIG. 5), according to some embodiments.

Figure 2A:
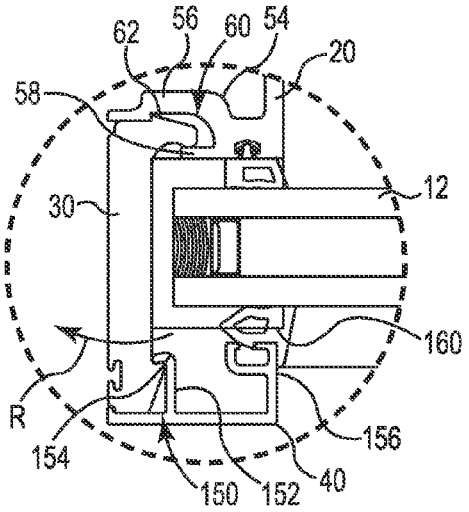
FIG. 2A is an enlarged view of a portion of FIG. 2, according to some embodiments.

FIG. 2A is an enlarged view of the first mullion 20 near the spacer lock 54, according to some embodiments. As shown, the spacer lock 54 includes a rear wall 56 and a front wall 58 combining to define a spacer channel 60 for receiving a portion of the first mullion spacer 30. As shown, the rear wall 56 includes a step, or recess 62 that is configured to form an interlocking fit with a portion of the first mullion spacer 30.

As shown in FIG. 2, the second mullion 22 includes a first interlocking tang 70, a second interlocking tang 72, and a spacer lock 74 that is substantially similar to the spacer lock 54 of the first mullion 20. The interlocking tangs 70, 72 are complementary in nature to the interlocking tangs 50, 52 and, in a curtain wall system, facilitate assembly of the first panel 10 to adjacent panels.

As shown in FIG. 3, the sill 24 forms a pocket 80 and includes a spacer lock 84. The spacer lock 84 optionally includes front and rear walls that define a spacer channel substantially similar to the spacer channel 60 of the first mullion 20, where the head 26 includes a neck 90 and spacer lock 94. The neck 90 is optionally adapted to carry one or more weather seals and is adapted to be received in a pocket, such as the pocket 80, of an adjacent panel in a panel stack of a curtain wall system. The spacer lock 94 optionally includes front and rear walls that define a spacer channel substantially similar to the spacer channel 60 (FIG. 2A) of the first mullion 20. As shown, the intermediate member 28 includes oppositely facing spacer locks 104, 106 that optionally each respectively include front and rear walls that define a spacer channel substantially similar to the spacer channel 60 of the first mullion 20.

As shown in FIG. 1, in terms of length, the first and second mullion spacers 30, 32 correspond generally in length to the first and second mullions 20, 22, the sill spacer 34 corresponds generally in length to the sill 24, and the head spacer 36 corresponds generally in length to the head 26. The upper intermediate spacer 37 generally spans the intermediate member 28 while the lower intermediate spacers 38 are a plurality of shorter spacers secured to the intermediate member 28 at discrete locations.

Figure 4:
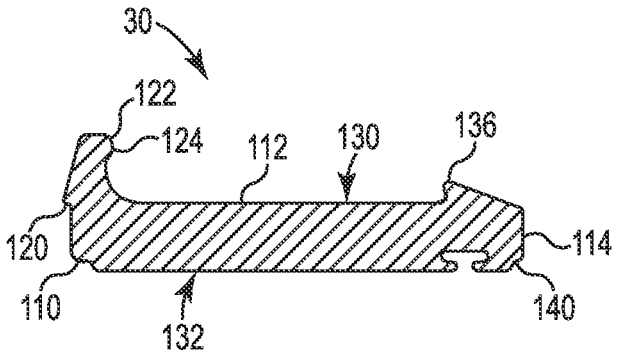
FIG. 4 is a transverse cross-section of a spacer of the first panel of FIG. 1, according to some embodiments.

FIG. 4 is a transverse cross-section of the first mullion spacer 30, according to some embodiments. In some embodiments, the various spacers 30, 32, 34, 36, 37, 38 have substantially similar cross-sections and thus are described collectively with spacer 30. As shown, the first mullion spacer 30 is substantially L-shaped or is hook shaped and includes a first end 110, a body 112, and a second end 114. The first end 110 forms the hook end, or lower bar of the L-shape and includes a shoulder or catch 120 and a nose 122 with a rounded tip 124. The body 112 is substantially planer and defines an inward face 130 and an outward face 132. The second end 112 is chamfered and also defines an inward catch 136 in the form of an inward projection and an outward catch 140 in the form of a recess into the second end 112. As shown, at the second end 112 the outward face 132 forms a T-shaped channel for receiving one or more assembly accessories, such as a weather seal.

As previously referenced, in some embodiments at least a portion of the first mullion spacer 30 (e.g., the body 112) is formed of a thermal insulating material, such as a polymeric material. In some embodiments, the entire first mullion spacer 30 is formed as a single, monolithic piece of material. One or more of the spacers also optionally provide substantial structural load bearing in the X, Y, and Z axis in the first panel 10. As such, a material with sufficient structural strength is selected according to various implementations. For example, one material that has been found to be particularly suitable for such applications is fiberglass material including a reinforcing mat sold under the trade name "DURACAST" fiberglass composite material by Pella Corporation, of Pella, Iowa. Examples of suitable fiberglass materials and associated methods of making can also be found in U.S. Pat. No. 7,276,132 to Davies et al., "Method of Making a Reinforcing Mat for a Pultruded Part," issued Oct. 2, 2007, the entire contents of which are incorporated herein by reference for all purposes. Other materials are also contemplated, for example co-extruded aluminum and vinyl spacers, where the aluminum serves as a structural core.

Figure 3A:
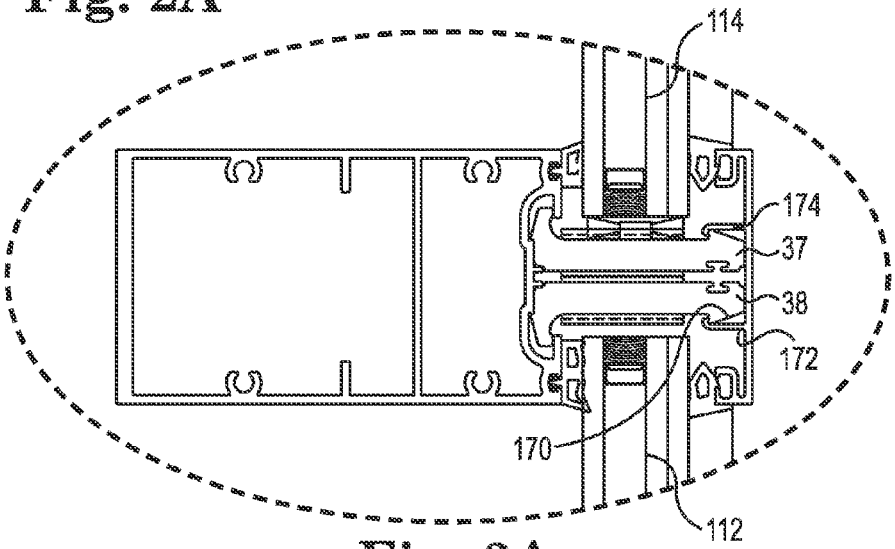
FIG. 3A is an enlarged view of a portion of FIG. 3, according to some embodiments.

In some embodiments, the first and second mullion covers 40, 42, sill cover 44, and the head cover 46 are substantially similar. As shown in FIG. 2A, the first mullion cover 40 includes a first catch 150 and a wall 152 terminating at a second catch 154. The first mullion cover 40 also includes a gasket catch 156 for receiving and securing a gasket 160. The first mullion cover 40 is optionally adapted to be cammed, or rotated and slid, onto the second end 114 (FIG. 4) of the first mullion spacer 30. The second mullion cover 42, the sill cover 44, and the head cover 46 are similarly adapted to cammed onto the second mullion spacer 32, sill spacer 34, and head spacer 36, respectively. As shown in FIG. 3A, the intermediate cover 48 defines an enlarged channel 170 with opposing walls 172, 174 adapted to be cammed onto the intermediate spacers 37, 38.

Figure 3B:
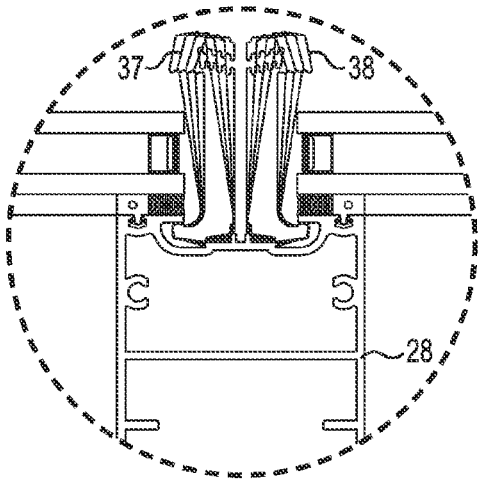
FIG. 3B shows a camming, assembly action of spacers used in the first panel of FIG. 1, according to some embodiments.

In some embodiments, assembly of the panel 10 includes assembling the first and second mullions 20, 22, the sill 24, the head 26, and the intermediate member 28 of the frame assembly 16 into the desired (e.g., rectangular) shape. Typically, the partially assembled frame assembly 16 is placed in a horizontal position and gaskets G (FIGS. 2 and 3) are installed into the frame assembly 16 and the first and second inserts 12, 14 are received against the gaskets G. The various spacers are then installed in the frame assembly 16 by camming the spacers into the various spacer locks (see, FIG. 2A and FIG. 3B), which provides an effective manner for assembling the components. For example, with respect to the first mullion spacer 30 and the first mullion 20, the first end 110 is inserted into the spacer channel 60 and as indicated in FIG. 2A, with the nose 122 in the channel 60, and the body 112 is rotated in the direction R to cam the catch 120 into the recess 62 to secure the first mullion spacer 30 to the first mullion 20, for example in an interference, cammed relationship.

Similarly, the second mullion spacer 32 is assembled to the second mullion 22, the sill and head spacers 34, 36 are secured to the sill and head 24, 26, and the intermediate spacers 37, 38 are secured to the intermediate member 28. The covers are then fit onto the spacers to capture and secure the inserts 12, 14 in place. In particular, as shown in FIG. 2A, the first mullion cover 40 is cammed onto the second end 114 of the first mullion spacer 30 with the first catch 154 engaging the inner catch 136 of the spacer 30 and the second catch 150 of the cover 40 engaging the outward catch 140 of the spacer 30. The gasket 160 is then inserted between the cover 154 and the insert 12 to help secure the insert in place. Similarly, the covers 42, 44, 46, 48 are secured to the second mullion spacer 32, the sill spacer 34, the head spacer 36, and the intermediate spacers 37, 38. Gaskets are received in the covers 42, 44, 46, 48 to form a captured assembly, with the inserts 12, 14 captured between the covers, gaskets, and the mullions 20, 22, sill 24, head 26, and intermediate member 28.

Thus, the various spacers 30, 32, 34, 36, 37, 38 provide an integral portion of the structure, and maintain structural integrity for securing the inserts 12, 14 to the frame assembly 16. Additionally, in some embodiments, at least some of the weight of the first insert 12 is supported on the inward face of the sill spacer 34 and at least some of the weight of the second insert 14 is supported on the inward face of the upper intermediate spacer 37. In other words, the spacers 34, 37 are load bearing in the sense that those spacers 34, 37 bear the weight of the inserts 12, 14, including after installation to the building structure. Additionally, the inserts 12, 14 are retained in position within the frame assembly 16 by the spacers. As shown in FIGS. 2 and 3, when formed of a thermally insulating material, such as "DURACAST" fiberglass composite material, the spacers 30, 32, 34, 36, 37, 38 provide an effective thermal break between the outer portion of the frame assembly 16 (e.g., the various covers 40, 42, 44, 46, 48) and the inner portion of the frame assembly (e.g., the mullions 20, 22, sill 24, head 26, and the intermediate member 28). In other words, the spacers are in a position to block the flow of heat between the interior and exterior of the frame assembly 16 from an exterior of the structure to which the first panel 10 is secured.

Figure 5:
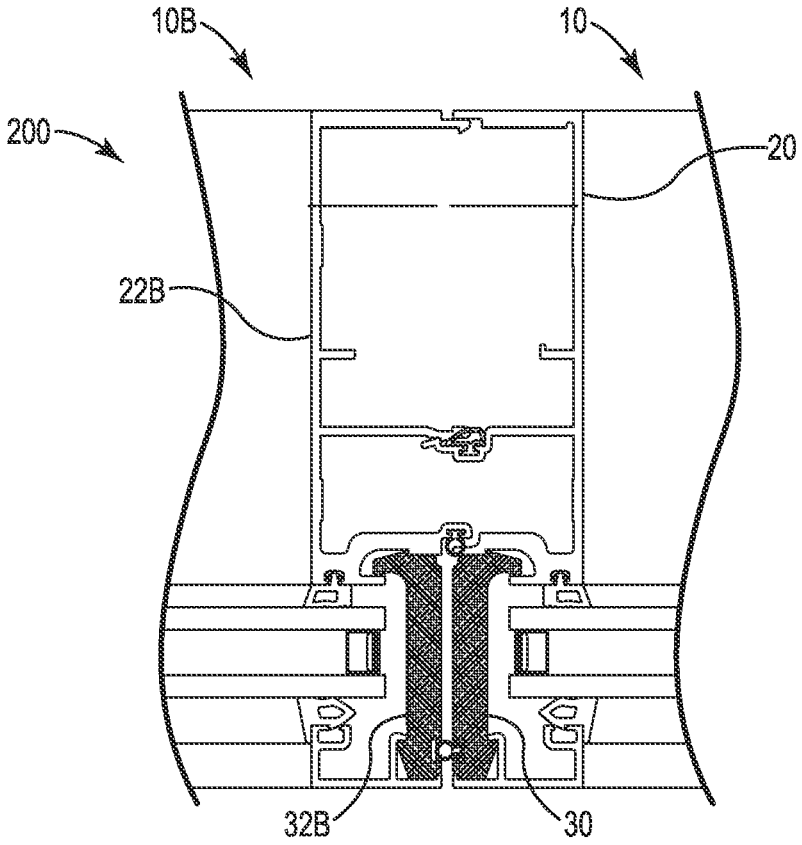
FIG. 5 shows a mullion interface of the first panel of FIG. 1 and an adjacent panel of a curtain wall system, according to some embodiments.
Figure 6:
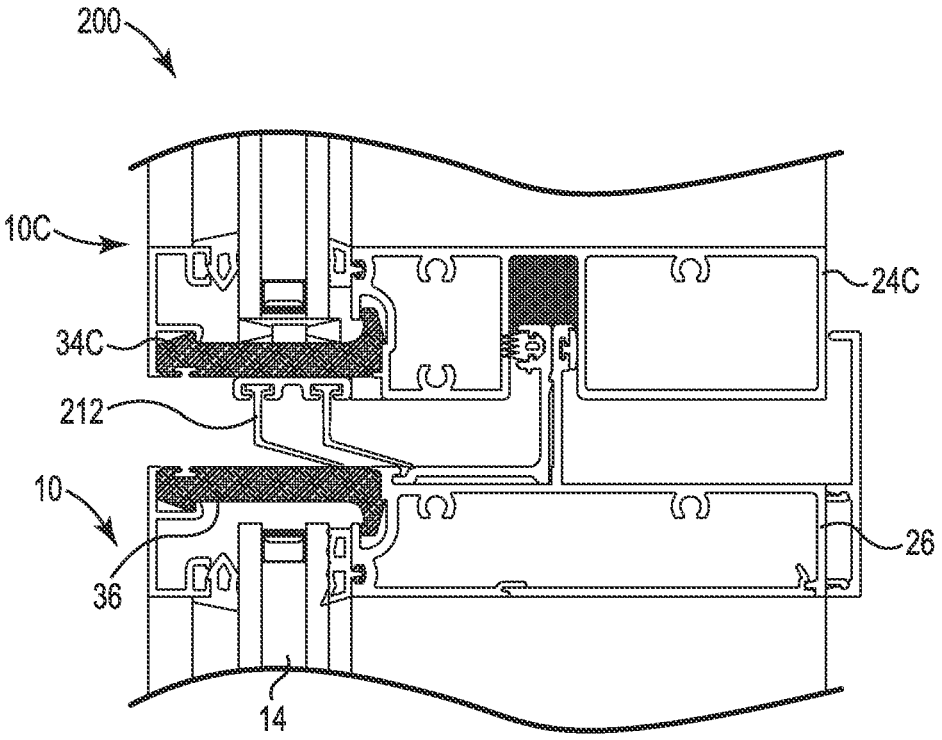
FIG. 6 shows a sill and head interface of the first panel of FIG. 1 and a stacked panel of a curtain wall system, according to some embodiments.

FIGS. 5 and 6 show the first panel 10 in a unitized curtain wall system 200, where FIG. 5 is downward-looking cross-sectional view showing the first panel 10 assembled mullion-to-mullion with a second, laterally adjacent panel 10B and FIG. 6 is a sideways-looking cross-sectional view showing the first panel 10 assembled head-to-sill to a vertically adjacent, or stacked, panel 10C, where the panels 10, 10B, and 10C are substantially similar. As shown in FIG. 5, during assembly to the building structure (not shown) the first mullion 20 is engaged with a second mullion 22B of the laterally adjacent panel 10B. As shown, a weather seal 210 is optionally secured to the first mullion spacer 30 and engaged with a second mullion spacer 32B of the adjacent panel 10B. Similarly, as shown in FIG. 6, during assembly to the building structure (not shown) the head 26 is engaged with a sill 24C of the vertically adjacent panel 10C. As shown, a weather seal 212 is optionally secured to a sill spacer 34C of the adjacent panel 10 and engaged with the head spacer 36 of the first panel 10.

Figure 8:
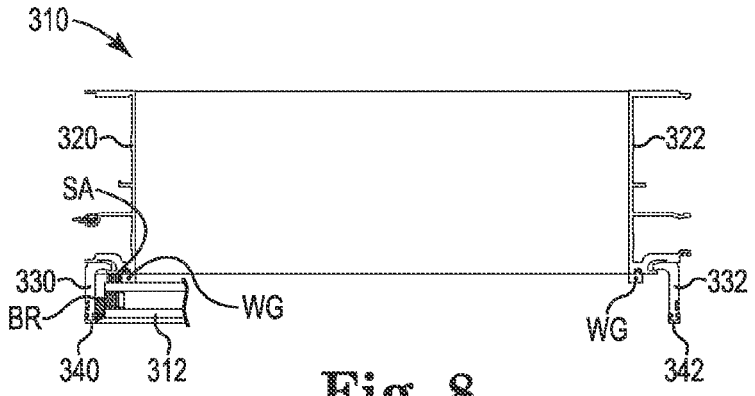
FIG. 8 is a sectional view of the second panel along line 8-8 of FIG. 7, according to some embodiments.
Figure 9:
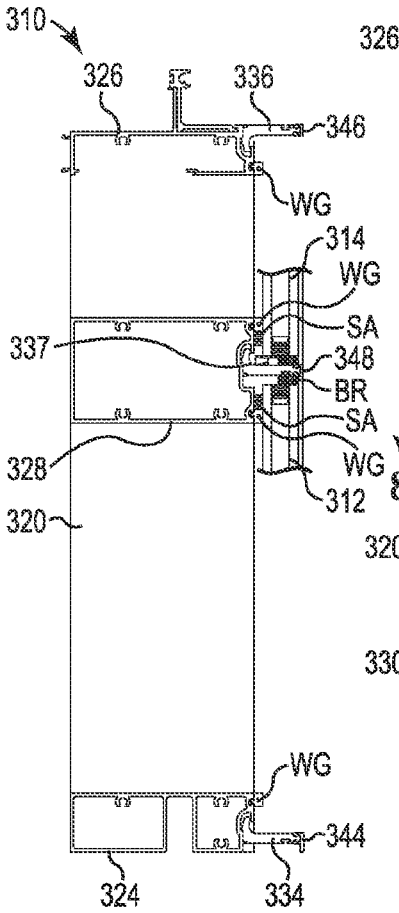
FIG. 9 is a sectional view of the second panel along line 9-9 of FIG. 7, according to some embodiments.
Figure 7:
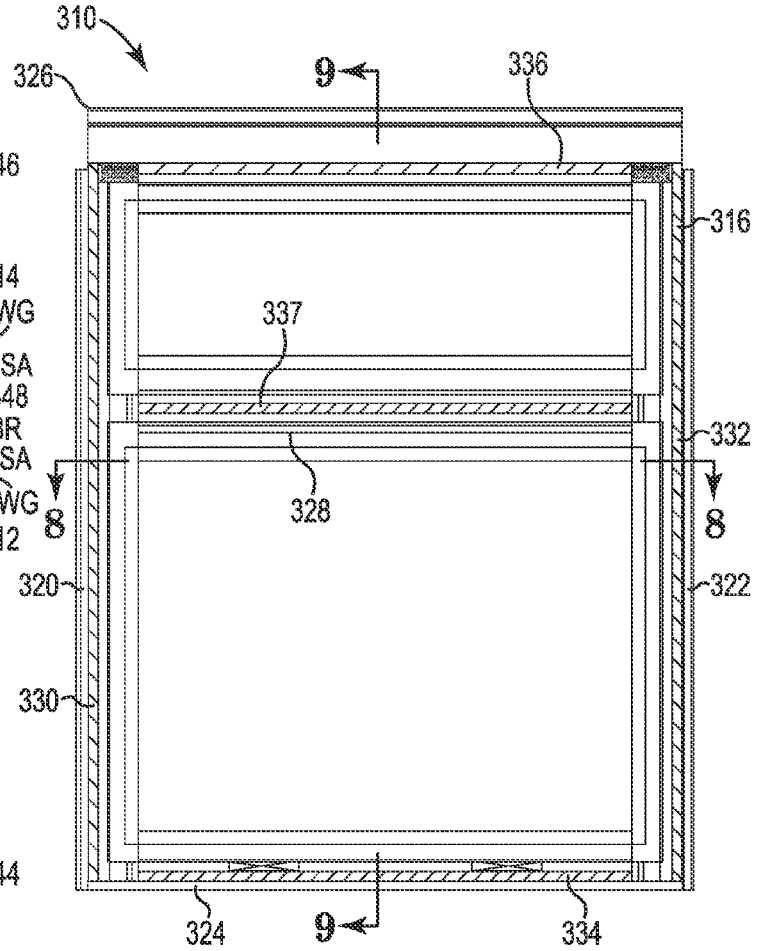
FIG. 7 is a front view of a second panel of a curtain wall system, according to some embodiments.

Although the first panel 10 is optionally a captured construct, or a construct in which structural adhesives are not utilized to maintain the inserts 12, 14 (e.g., a "dry glaze" construct), constructs including structural adhesive are also contemplated. For example, FIGS. 7-11 show a second panel 310 of a curtain wall system, according to some embodiments. FIG. 7 is a front view of the second panel 310, FIG. 8 is a sectional view of the second panel 310 along line 8-8 in FIG. 7, and FIG. 9 is a sectional view of the second panel 310 along line 9-9 in FIG. 7, according to some embodiments. As shown, the second panel 310 includes a first insert 312, a second insert 314, and a frame assembly 316 supporting the first and second inserts 312, 314. In some embodiments, the first and second inserts 312, 314 are secured into the frame assembly 316 (e.g., in a factory or remote site from a building site) and the entire second panel 310 along with a plurality of substantially similar panels forming the curtain wall system are secured to the building structure.

Various components of the second panel 310 are optionally substantially similar to the first panel 10, although the second panel 310 is optionally assembled with a structural adhesive SA (also called a structural sealant) securing the inserts 312, 314 to the frame assembly 316. As shown, the frame assembly 316 includes first and second mullions 320, 322, a sill 324, a head 326, an intermediate member 328, first and second mullion spacers 330, 332, a sill spacer 334, a head spacer 336, and an intermediate spacer 337. The frame assembly 316 also includes a first mullion cover 340, a second mullion cover 342, a sill cover 344, a head cover 346, and an intermediate cover 348 (the covers are not shown in FIG. 7). The mullions 320, 322, sill 324, head 326, intermediate member 328, and covers 340, 342, 344, 346 are optionally formed of extruded aluminum material, or other material as desired. In some embodiments, one or more of the spacers act as structural components that help support the inserts 312, 314. As described in greater detail, one or more of the spacers 330, 332, 334, 336, 337, 338 are formed of a thermal insulating material (e.g., as opposed to metals such as aluminum or steel, which are generally considered thermally conductive).

Figure 10:
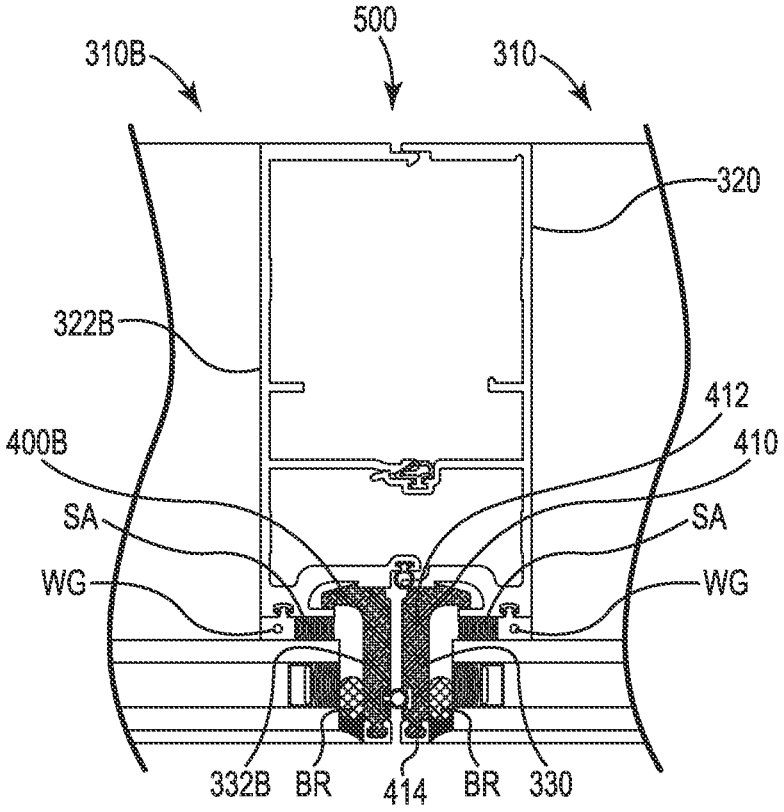
FIG. 10 shows a mullion interface of the second panel of FIG. 7 and an adjacent panel of a curtain wall system, according to some embodiments.
Figure 11:
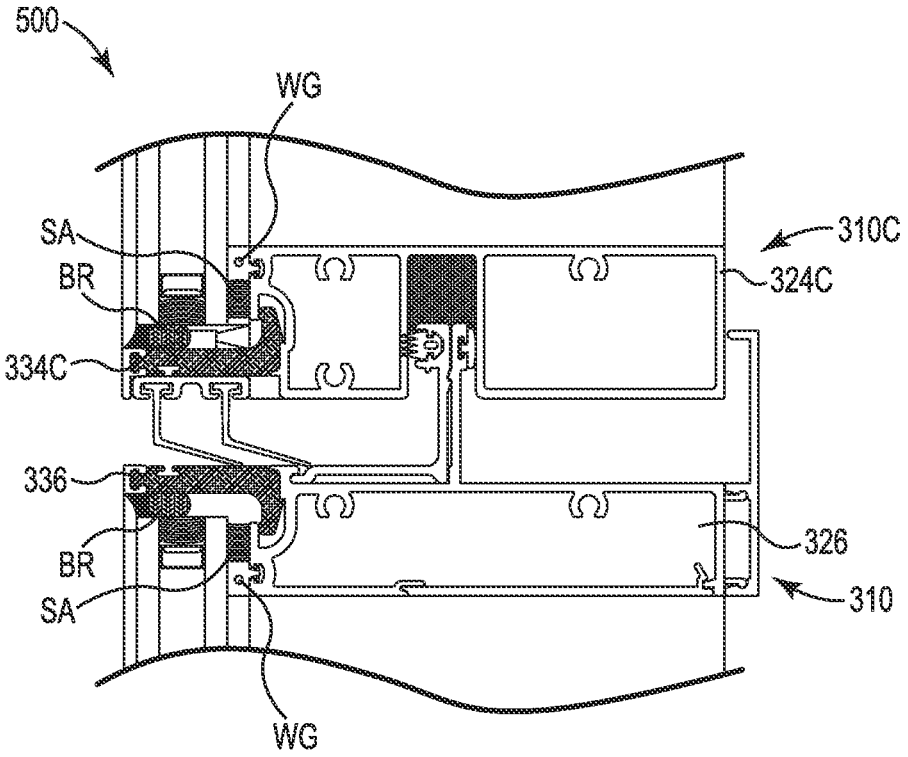
FIG. 11 shows a sill and head interface of the second panel of FIG. 7 and a stacked panel of a curtain wall system, according to some embodiments.

FIGS. 10 and 11 show the second panel 310 in a unitized curtain wall system 500, where FIG. 10 is downward-looking cross-sectional view showing the second panel 310 assembled mullion-to-mullion with a laterally adjacent panel 310B and FIG. 11 is a sideways-looking cross-sectional view showing the second panel 310 assembled head-to-sill to a vertically stacked, panel 310C, wherein the panels 310, 310B, 310C are substantially similar.

As shown in FIG. 10, the first mullion spacer 330 has a first end 410 and a body 412 that are substantially similar to that of the spacer 30, although a second end 414 of the fist mullion spacer 330 defines a generally bulbous shape. As shown in FIGS. 7-9, the other spacers 332, 334, 336, 337 are similarly shaped. In turn, the covers 340, 342, 344, 346, 348 are also substantially similar and are configured to slide onto the spacers to form an interference fit with the second ends of the respective spacers 330, 332, 334, 336, 337. As with the first panel 10, in some embodiments at least a portion of the spacers of the second panel 310 are formed of a thermal insulating material.

In some embodiments, assembly of the second panel 310 includes assembling the first and second mullions 320, 322, the sill 324, the head 326, and the intermediate member 328 of the frame assembly 316 into the desired (e.g., rectangular) shape. The partially assembled frame assembly 316 is placed in a horizontal position and weathering gaskets WG (FIGS. 2 and 3) are installed into the frame assembly 316 and the first and second inserts 312, 314 are received against the gaskets WG. In some embodiments, a structural adhesive SA is applied between the inserts 312, 314 and the first and second mullions 320, 322, the sill 324, the head 326, and the intermediate member 328. Similarly to the first panel 10, the various spacers 330, 332, 334, 336, 337 are assembled to the frame assembly 316 by camming the spacers into spacer channels of the mullions 320, 322, sill 324, head 326, and intermediate member 328. The covers 34, 342, 344, 348 are added to the spacers before or after installation into the frame assembly 16. One or more backer rods BR are installed between the spacers and the inserts 312, 314 as shown. Additional sealant and weather stripping is applied as desired.

As shown, the various spacers 330, 332, 334, 336, 337 provide an integral portion of the structure, and maintain structural integrity for securing the inserts 312, 314 to the frame assembly 316. For example, in some embodiments, immediately following assembly, the structural adhesive SA is not fully cured and does not provide substantial structural support; it may take days for a full cure. In some embodiments, during at least that cure time, the spacers provide structural support to the second panel 310. As such, the second panel 310 is able to be more easily moved and stored (e.g., in a vertical configuration) immediately following assembly. Moreover, when formed of a thermally insulating material, such as DURACAST fiberglass composite material, the spacers 330, 332, 334, 336, 337 provide an effective thermal break between the outer portion of the frame assembly 316 (e.g., the various covers 340, 342, 344, 346, 348) and the inner portion of the frame assembly (e.g., the mullions 320, 322, sill 324, head 326, and the intermediate member 328).

Figure 12:
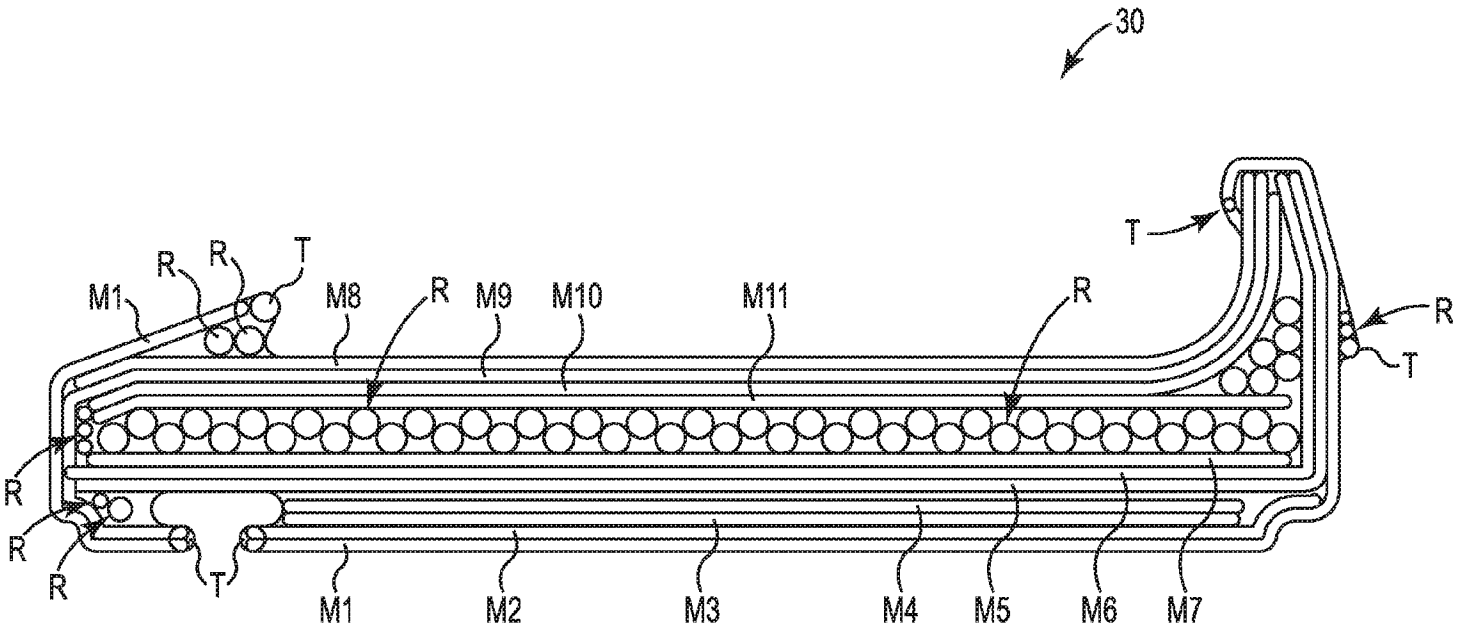
FIG. 12 shows a pultrusion profile of a first mullion spacer of the first panel of FIG. 1, according to some embodiments.

As previously described, in some embodiments, the various spacers are pultruded parts of a fiberglass composite. FIG. 12 is a pultrusion profile of the first mullion spacer 30 of the first panel 10, according to some embodiments. As shown, the pultruded profile includes a plurality of reinforcing structures, or reinforcing mats M1-M11 that provide structural support to the part. Suitable reinforcing structures are available from Pella Corporation of Pella Iowa. Suitable reinforcing structures are also disclosed in U.S. Pat. No. 7,276,132 to Davies et al., "Method of Making a Reinforcing Mat for a Pultruded Part," issued Oct. 2, 2007 (previously incorporated). As shown, the pultrusion profile also includes a plurality of rovings R located in the core of the profile as well as a plurality of rovings R of various diameters and texo yarns T adjacent a perimeter of the pultrusion profile. The profile also optionally includes a heat set resin coating on an exterior surface of the part, according to some embodiments.

Figure 13:
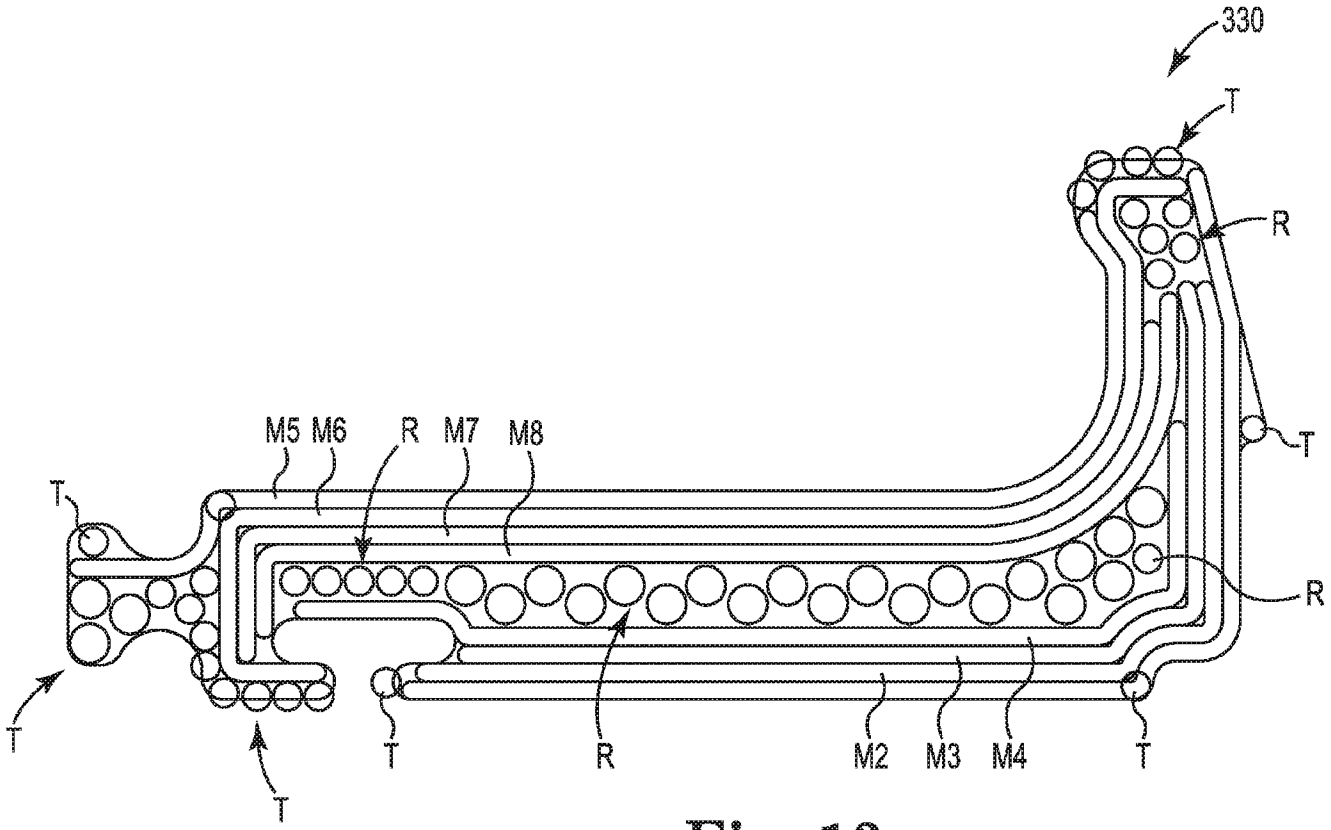
FIG. 13 shows a pultrusion profile of a first mullions spacer of the second panel of FIG. 7, according to some embodiments.

FIG. 13 is a pultrusion profile of the first mullion spacer 330 of the first panel 10, according to some embodiments. As shown, the pultruded profile includes a plurality of reinforcing structures, or reinforcing mats M1-M8 that provide structural support to the part. Suitable reinforcing structures are available from Pella Corporation of Pella Iowa. Suitable reinforcing structures are also disclosed in U.S. Pat. No. 7,276,132 to Davies et al., "Method of Making a Reinforcing Mat for a Pultruded Part," issued Oct. 2, 2007 (previously incorporated). As shown, the pultrusion profile also includes a plurality of rovings R of multiple diameters located in the core of the profile as well as a plurality of rovings R of various diameters and texo yarns T adjacent a perimeter of the pultrusion profile. The profile also optionally includes a heat set resin coating on an exterior surface of the part, according to some embodiments.

Various modifications and additions can be made to the exemplary embodiments discussed without departing from the scope of the present invention. For example, while a camming or interference fit has been described for installing the spacers and covers, additional methods and associated spacer configurations for fastening are contemplated, such as slide in, snap fits, mechanical fasteners, bonding (e.g., chemical or thermal), or combinations thereof. While the embodiments described above refer to particular features, the scope of this invention also includes embodiments having different combinations of features and embodiments that do not include all of the above described features.

We claim:

1. A curtain wall panel including:

a frame configured to be secured to an exterior surface of a building structure, the frame including a first mullion, a second mullion, a sill, and a head;

a first insert having a weight and being secured to the frame;

a first structural spacer having a length, a first end, and a body, the first end and the body extending along the length of the first structural spacer, the first structural spacer securing the first insert to the frame and supporting the weight of the first insert, the first structural spacer being formed of a thermally insulating material, wherein the first end of the first structural spacer is configured to be secured within a channel of the frame by inserting the first end into the channel and rotating the first structural spacer about the first end;

a second insert having a weight, and a second structural spacer formed of a thermally insulating material, wherein the frame further comprises an intermediate member extending between the first and second mullions and positioned intermediate the head and the sill, and further wherein the second structural spacer is secured to the intermediate member and secures the second insert to the frame and supports the weight of the second insert; and a third structural spacer formed of a thermally insulating material and secured to the intermediate member, the first structural spacer being secured to the sill of the frame below the first insert, the second structural spacer being secured to the intermediate member below the second insert, and the third structural spacer being secured to the intermediate member below the second structural spacer, the curtain wall panel further comprising an intermediate cover defining a channel adapted to form an interference fit with the second and third structural spacers.

2. The curtain wall panel of claim 1, wherein the thermally insulating material is a fiberglass material including a reinforcing mat.

3. The curtain wall panel of claim 1, wherein the thermally insulating material includes a plurality of reinforcing mats.

4. The curtain wall panel of claim 1, wherein the first structural spacer defines a longitudinal axis and a transverse cross-section orthogonal to the longitudinal axis, the spacer being substantially L-shaped in transverse cross-section.

5. The curtain wall panel of claim 4, wherein the first structural spacer is formed as a pultruded part that has been pultruded in a direction of the longitudinal axis.

6. The curtain wall panel of claim 5, wherein the pultruded part defines an exterior surface that includes a heat set resin coating.

* * * * *